US010610038B2

(12) United States Patent
Roark

(10) Patent No.: US 10,610,038 B2
(45) Date of Patent: Apr. 7, 2020

(54) DEVICE FOR RETAINING A SHOE TONGUE

(71) Applicant: Matthew Roark, Lewes, DE (US)

(72) Inventor: Matthew Roark, Lewes, DE (US)

( * ) Notice: Subject to any disclaimer, the term of this patent is extended or adjusted under 35 U.S.C. 154(b) by 72 days.

(21) Appl. No.: 16/050,496

(22) Filed: Jul. 31, 2018

(65) Prior Publication Data

US 2019/0038060 A1 Feb. 7, 2019

Related U.S. Application Data

(60) Provisional application No. 62/539,643, filed on Aug. 1, 2017.

(51) Int. Cl.
*A47G 25/80* (2006.01)
*A43B 23/20* (2006.01)
*A43C 19/00* (2006.01)

(52) U.S. Cl.
CPC ..... *A47G 25/80* (2013.01); *A43B 23/20* (2013.01); *A43C 19/00* (2013.01)

(58) Field of Classification Search
CPC .. A47G 25/80–85; A43B 23/20; A43B 23/26; A43B 23/24; A43B 23/25; A43C 19/00
See application file for complete search history.

(56) References Cited

U.S. PATENT DOCUMENTS 537,934 A 4/1895 Patton
728,959 A 5/1903 Morse
887,942 A * 5/1908 Houghland ..... A43C 7/00 24/712.4
1,472,519 A * 10/1923 Gingrich ..... A43C 11/20 24/712.7
1,489,000 A 4/1924 Mitchell
4,584,783 A 4/1986 Dobbin
5,313,719 A * 5/1994 Koethe ..... A43C 13/14 36/136
5,379,529 A * 1/1995 Smith ..... A43B 5/00 36/50.1
5,755,044 A 5/1998 Veylupek
6,397,497 B1 * 6/2002 McAtee ..... A43B 3/0078 36/136
6,973,700 B2 * 12/2005 Hsiao ..... B42F 1/02 24/545
8,683,716 B2 4/2014 Raysse et al.
8,800,173 B2 * 8/2014 Smith ..... A43C 7/00 24/712.4
2006/0248693 A1 * 11/2006 Walker ..... A43C 7/005 24/712.2
2013/0232734 A1 * 9/2013 Schein ..... A43B 3/0078 24/302

OTHER PUBLICATIONS

Website, onfancy.com, Silicone Shoelace V-Tie Elastic Slip-On No Tie Laces Customize Fashion Gift, http://www.onfancy.com/lacet-silicone-v-tie-elastique-slip-on-pas-lacer-personnaliser-cadeau-de-mode.html, Jan. 14, 2019.

* cited by examiner

*Primary Examiner* — Ismael Izaguirre
(74) *Attorney, Agent, or Firm* — Paul & Paul

(57) ABSTRACT

A device for retaining a shoe tongue in a fixed position includes a first portion adapted to be retained within an eyelet of a shoe and a second portion adapted to retain a shoe tongue in a fixed position.

5 Claims, 1 Drawing Sheet

DEVICE FOR RETAINING A SHOE TONGUE

FIELD OF THE INVENTION

The present invention relates generally to an apparatus for a shoe. More specifically, the present invention is an apparatus for a shoe that attaches to the tongue of the shoe to prevent the tongue from folding forward.

BACKGROUND OF THE INVENTION

Shoe collectors stand in line for hours to wait for the newest shoes on the market. These shoes can cost hundreds of dollars and resold for even more money. Quality is important and any items to help keep the shoe looking its best, especially after being worn, can keep value high for the shoe. In boots, the tongue may eventually slouch forward, this decreases value for the shoe, gives less protection for the shoe, and makes the shoe looks undesirable.

DETAILED DESCRIPTION

All illustrations of the drawings are for the purpose of describing selected versions of the present invention and are not intended to limit the scope of the present invention.

The present invention provides a device that attaches to the side of the tongue of a shoe or boot. In a presently preferred embodiment, the device attaches to a shoe tongue by means of a mechanical clip. In another embodiment, the device is attached to the shoe tongue adhesively, such as through double-sided tape. The device also includes a portion which engages an eyelet of the shoe or boot, preferably the uppermost eyelet or hole intended to receive a shoe lace.

The device of the present invention prevents the tongue from folding down/forward causing damage to the boot, less protection for the wearer, and decreased desirability to wear the shoe itself.

The device addresses a common problem for people that wear pants tucked into their boot or shorts with boots. The device holds the tongue of the shoe in place preventing unwanted flopping of a loose tongue. The device attaches to the body of the shoe and works to retain the tongue in a set and predetermined position. The device advantageously provides improved convenience, improved longevity of the shoe, improved protection provided for the tongue as it is held in place, and reduced damage to the shoe.

Figure 1:
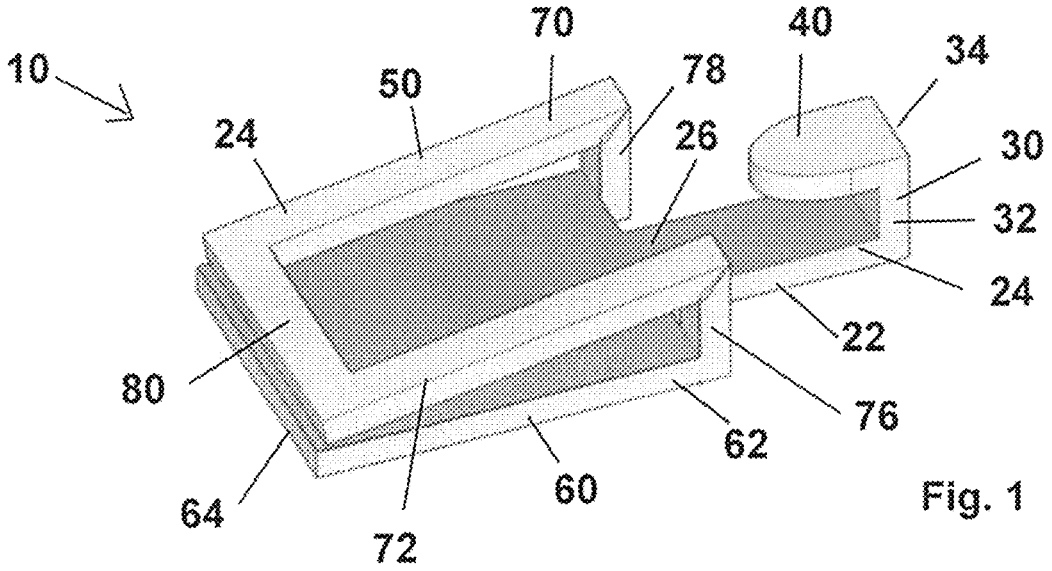
FIG. 1 is a perspective view of a device for retaining a shoe tongue according to the present invention.
Figure 2:
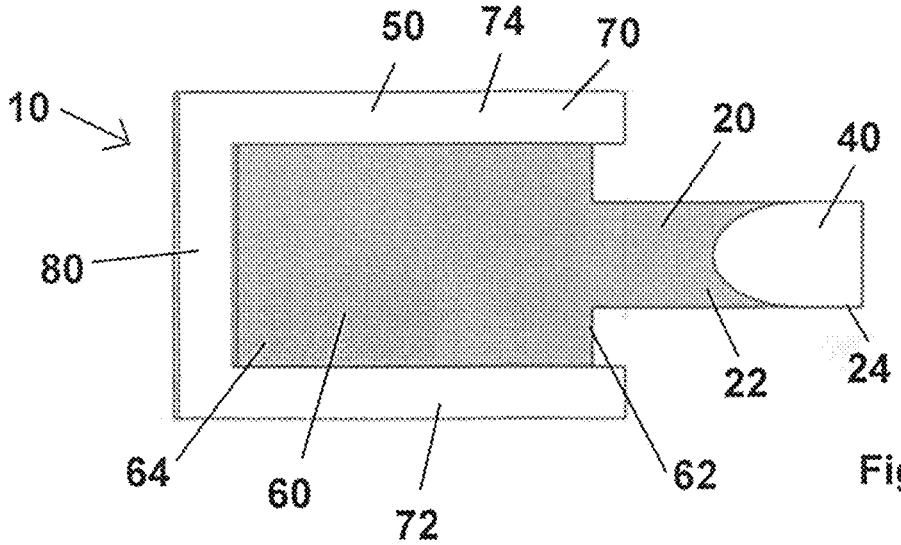
FIG. 2 is a top plan view of the device of FIG. 1.
Figure 3:
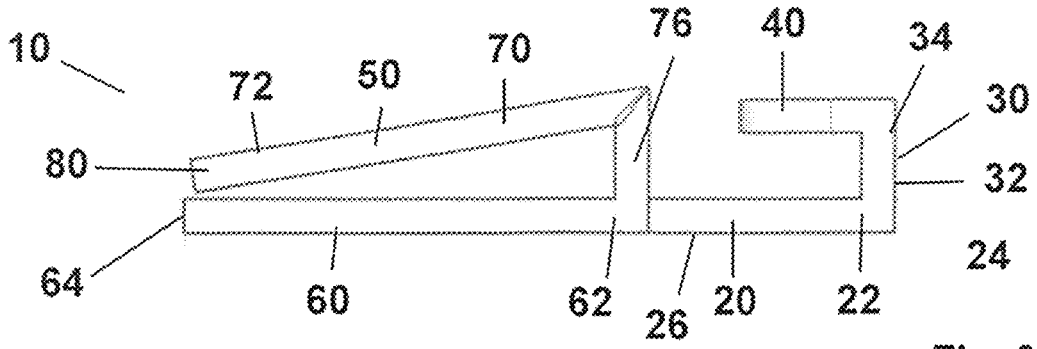
FIG. 3 is a side elevational view of the device of FIG. 1.

Turning now to the figures in which like elements are identified by like reference numerals, there is shown in FIG. 1 a perspective view of a currently preferred embodiment of a device 10 according to the present invention. The device 10 is intended to retain a shoe tongue in a fixed position (not shown). The device 10 comprises a first portion 20 adapted to be retained within an eyelet or lace hole of a shoe or boot (not shown) and a second portion 50 adapted to retain a shoe tongue in a fixed position (not shown).

The first portion 10 includes a rearwardly extending neck 22 including a first end 24 and a second end 26, an upwardly extending bridge 30 having a lower end 32 proximate the neck 30 and an upper end 34, the bridge 30 extending from the first end 24 of the neck 20, and a forwardly extending pin 40 extending from the upper end 34 of the bridge 30, the pin 40 being adapted to pass through a shoe eyelet (not shown), the pin 40 being spaced from and parallel to the neck 20.

The second portion 50 includes a base 60 extending rearwardly from the neck 22 and coplanar to the neck 22 of the first portion 20, the base 60 having a first end 62 proximate the neck 22 and a second end 64, and a clip 70 for securing the tongue of a shoe to the base 60, the clip 70 being attached to the base 60 at the first end 62 of the base 60.

Preferably, the device 10 includes a clip 70 which includes a pair of rearwardly extending prongs 72, 74, each prong 72, 74 extending from upwardly extending posts 76, 78.

Preferably, the clip 70 further includes a cross member 80 extending between the prongs 72, 74.

In another embodiment of the present invention, the clip includes a single prong (not shown). In another embodiment of the present invention, the prong or prongs 72, 74 are biased by spring means against the base 60 (not shown).

In one aspect of the present invention, the device is formed from metal. In yet another aspect of the present invention the device is formed from a thermoplastic material.

Various modifications can be made in the details of the various embodiments of the method of the present invention, all within the scope and spirit of the invention as defined by the appended claims.

The invention claimed is:

1. A device for retaining a shoe tongue in a fixed position, the device comprising:

a first portion adapted to be retained within an eyelet of a shoe and a second portion adapted to retain a shoe tongue in a fixed position, the first portion including a rearwardly extending neck including a first end and a second end, an upwardly extending bridge having a lower end proximate the neck and an upper end, the bridge extending from the first end of the neck, and a forwardly extending pin extending from the upper end of the bridge, the pin being adapted to pass through a shoe eyelet, the pin being spaced from and parallel to the neck, the second portion including a base extending rearwardly from the neck and coplanar to the neck of the first portion, the base having a first end proximate the neck and a second end, and a clip for securing the tongue of a shoe to the base, the clip being attached to the base at the first end of the base.

2. A device according to claim 1 wherein the clip includes a pair of rearwardly extending prongs, each prong extending from upwardly extending posts.

3. A device according to claim 2 wherein the clip further includes a cross member extending between the prongs.

4. A device according to claim 1 wherein the device is formed from metal.

5. A device according to claim 1 wherein the device is formed from a thermoplastic material.

* * * * *